US005453128A

United States Patent [19]

Kustermann et al.

[11] Patent Number: 5,453,128

[45] Date of Patent: Sep. 26, 1995

[54] COATING SYSTEM FOR RUNNING WEBS OF PAPER OR CARDBOARD

[75] Inventors: Martin Kustermann, Heidenheim, Germany; Sergio Giuste, Jaragua Sao paulo, Brazil

[73] Assignee: J. M. Voith GmbH, Heidenheim, Germany

[21] Appl. No.: 233,073

[22] Filed: Apr. 26, 1994

[30] Foreign Application Priority Data

Apr. 28, 1993 [DE] Germany ..... 43 13 889.6

[51] Int. Cl.[6] ..... B05C 11/04

[52] U.S. Cl. ..... 118/123; 15/256.51; 15/256.52; 118/126; 118/413; 118/419; 162/281

[58] Field of Search ..... 118/663, 712, 118/104, 123, 126, 203, 261, 413, 419; 162/281; 101/350, 363; 15/256.51, 256.52; 427/8, 356; 356/381, 154; 250/561

[56] References Cited

U.S. PATENT DOCUMENTS

| | | | |
|---|---|---|---|
| 4,991,969 | 2/1991 | Tokumaru et al. | 356/381 |
| 5,221,351 | 6/1993 | Esser et al. | 118/413 |
| 5,242,498 | 9/1993 | Kohler et al. | 118/663 |
| 5,338,361 | 8/1994 | Anderson et al. | 118/413 |

FOREIGN PATENT DOCUMENTS

| | | |
|---|---|---|
| 2029663 | 10/1991 | Canada . |
| 426980 | 9/1990 | European Pat. Off. . |
| 2913421 | 10/1980 | Germany . |
| 3236991 | 4/1984 | Germany . |

*Primary Examiner*—W. Gary Jones
*Assistant Examiner*—Laura E. Edwards
*Attorney, Agent, or Firm*—Baker & Daniels

[57] ABSTRACT

An arrangement for dosing with a blade, in coating machines or similar, onto a running web of paper or cardboard carried by a roll in or with the arrangement. The blade is forced by means of a hold-down or several hold-down sections on the roll respectively the web. A transmitter transmits light, notably laser light. The blade features in the area between the contact line of the hold-down on it, and its contact line on the roll respectively the web, on its side away from the roll, at least one light-reflecting layer for reflection of the light ray directed by the transmitter at the layer. A receiver registers the position or angle of the ray reflected upon it by the light-reflecting layer of the blade. A controller is provided for controlling, dependent on the position signal of the receiver for the reflected light ray, the angular position of the blade, notably in its area between the contact line of the hold-down or the hold-down section and the roll.

11 Claims, 1 Drawing Sheet

COATING SYSTEM FOR RUNNING WEBS OF PAPER OR CARDBOARD

BACKGROUND OF THE INVENTION

The invention concerns a dosing arrangement for coating running webs with a blade in coating machines and the like. The dosing system employs a so-called doctor blade, wherein directly or at some distance, of perhaps 30–50 cm, a feed system for the coating mixture may be coordinated with the doctor blade along the periphery of a roll carrying the web of paper or cardboard. The arrangement also may be such that the paper web runs onto the roll only later, so that merely the roll shell receives a coating first, with the coating mixture being transferred only later from the roll shell to the paper web.

A categorical system is known from EP-A 04 26 980. This application describes, e.g., also a measuring system with a transmitter that emits light which is registered by a light-sensitive receiver arrangement, for instance in the form of a diode serial array or CCD camera. The output signal of this arrangement is then processed in order to adjust the angular position of the doctor blade in relation to the roll circumference, at the point of contact of the blade with said roll circumference. Despite their miniature style, all measuring systems described in this application still are relatively large and have a weight which is not quite negligible.

The problem underlying the present invention is to provide such a measuring device in which a sensor of noticeable weight is being avoided. Another problem, also, is to fashion the measuring system in such a way that a quick blade exchange, including the measured value transfer systems, is possible.

SUMMARY OF THE INVENTION

This problem is inventionally solved by the features of the present invention. Owing to the light-sensitive layer applied on the doctor blade, which sends the light radiated at it by a transmitter and reflected in accordance with the known law of reflection to a receiver, the doctor blade is stressed only locally by negligible additional weights, and a quick exchange of the latter is possible. When used, a reflective strip can be applied on the blade before its assembly. When using mirrored laminae as a reflective layer of the blade, favorable angles of incidence and emergence of the measuring rays are obtainable by tapering the substrate of the mirrored surface. Furthermore, the substrate may be magnetic, which enables a quick attachment to the blade and removal from it.

Also possible is a non-contact arrangement on inductive or capacitive or supersonic basis, where the sensor is arranged a specific distance from the blade hold-down or mounting, so that the blade angle can be calculated based on the blade spacing from the sensor in this region making allowance for the contact force of the blade.

BRIEF DESCRIPTION OF THE DRAWINGS

The invention will be explained hereafter with the aid of the embodiments illustrated in the drawing figures, wherein.

DETAILED DESCRIPTION OF THE INVENTION

Figure 1:
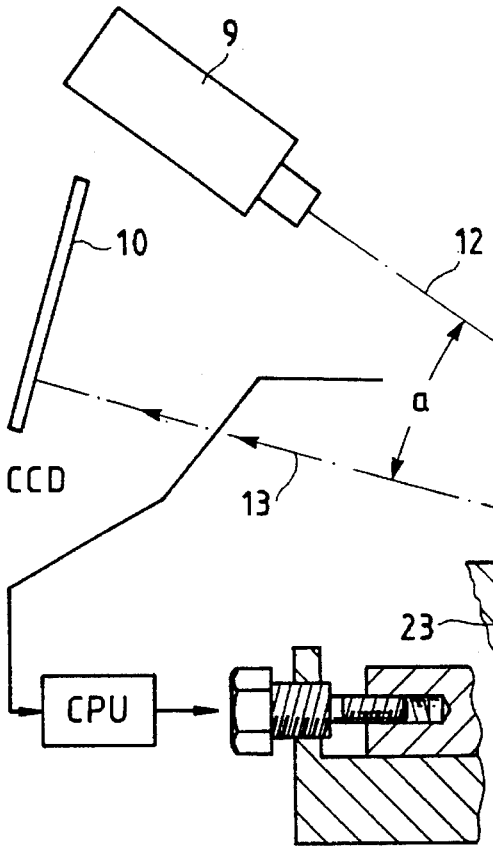
FIG. 1 shows a basic illustration of the inventional measuring system in side elevation.

In FIG. 1, the doctor blade 2 is mounted in jaws 3 and 4 of a holder and forced on the backing roll R by means of a hold-down device 5 which is held between guide plates 23 and 29 so as to be movable according to the double arrow. Hold-down device 5 may comprise a single device, or alternatively, several hold-down sections fashioned together to comprise device 5. Hold-down device 5 may be fashioned relatively flexible in the transverse direction to the blade. A light transmitter 9, notably for laser light, directs light ray 12 at a light-reflecting layer 8', which light ray 12 then proceeds as reflected ray 13 at a spreading angle a to the receiver 10 in the form of a CCD (charge-coupled device) camera. The reflective layer 8' shown in FIG. 1 is the mirrored layer of a mirrored lamina 6 which by means of a magnetic substrate 7 is detachably assembled to the doctor blade, which, of course, consists of magnetizable steel. The substrate 7 tapers at an angle c in order to obtain a favorable progression of the angle of incidence of light ray 12 and angle of reflection of light ray 13. This provides sufficient space which in favorable fashion allows arrangement of transmitter 9 and receiver 10 near the doctor blade.

The adjustment device shown in FIG. 1 has the form of one or more lead screws which at a specific pitch are distributed across the width of the blade. Alternative devices such as hoses can also be used as adjustment devices to which pressure can be admitted, and which can act upon and be effective either at the hold-down bar, or, directly on the blade. In the case of hoses, a change of contact pressure can be effected by changing the pressure in the hoses. The arrangement of the adjustment devices is preferably such that a maximally even pressure distribution is obtained across the width of the blade. In an alternative embodiment, the arrangement has a locally adjustable contact pressure across the width of the blade. This may be brought about, for example, by different adjustment of the lead screws distributed at a specific spacing across the width of the blade, or hydraulic power elements, or by means of a plurality of pressure cushions arranged at a specific spacing across the width of the blade, which pressure cushions are able to vary the pressure applied on the blade by a change of their degree of inflation. Adjustment devices acting upon a hold-down bar are known, for example, from DE 29 13 421 (U.S. Pat. No. 4,309,960), and DE 32 36 991. The arrangement of the adjustment devices is such that they are coordinated with the hold-down bar. The adjustment devices may be arranged in the area of the coating blade holder, and also mounted on it. There are other options for coordinating the adjustment devices with the hold-down bar, but the adjustment device is preferably arranged on the applicator system.

Figure 3:
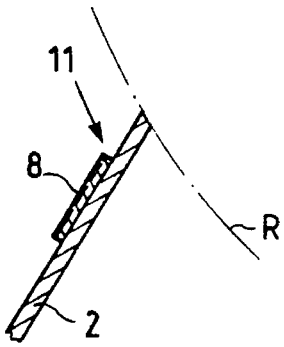
FIG. 3 shows a corresponding arrangement of another variant.

FIG. 3 illustrates that the reflective layer 8 can be applied also on a foil which may be glued to the doctor blade 2 or—fashioned as magnetic foil—simply placed on the doctor blade. A strip of, e.g., 5 cm length can be used here and applied at the right spot on the doctor blade already before its installation. The down time of the coating system due to doctor blade change becomes thus extremely short. The substrate and the light-reflecting layer applied on the substrate may comprise glass, mirrored laminae preferably measuring maximally 25 $mm^2$. Additionally, the weight per unit area of the foil including the light-reflecting layer is preferably maximally 50 $g/m^2$.

Figure 2:
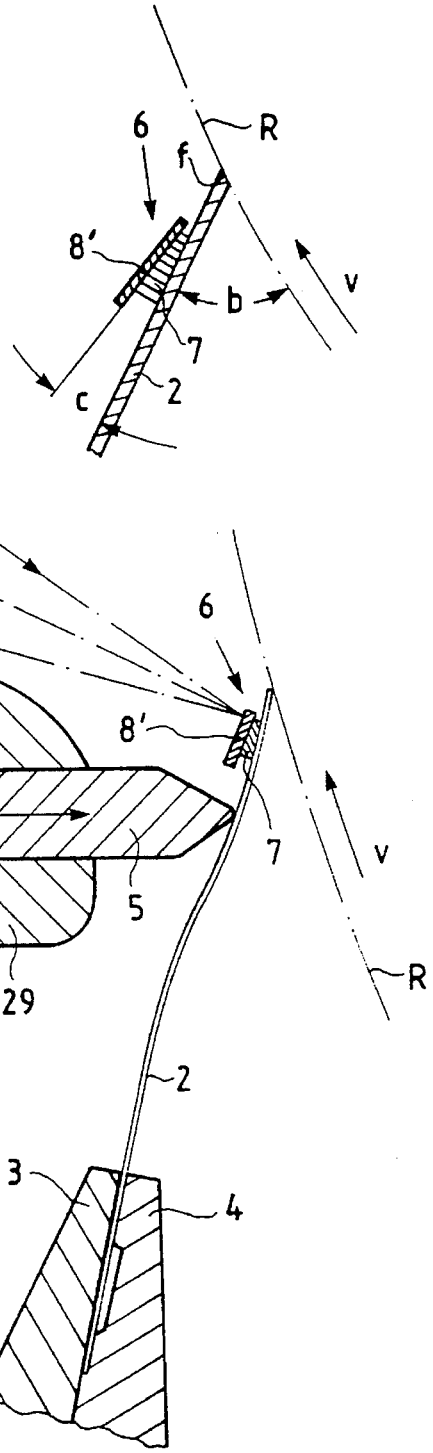
FIG. 2 shows a detail in the area of the blade's contact edge on the backing roll, scaled up.

The signal from the receiver 10 is then sent to a control system (CPU), in order to be able to adjust the doctor blade angle, namely the angle b at which the doctor blade in FIG. 1 and 2 is set on the backing roll R. According to this angle extends also the actual blade edge (chamfer f) at the end of the blade in relation to the backing roll R, and the paper web carried by it. Of course, the chamfer f is to extend exactly tangentially to the backing roll and paper web, which passes at the velocity v by the doctor blade in accordance with the illustrated arrow.

What is claimed is:

1. An apparatus for dosing a running web, comprising:

a roll for carrying the running web;

a blade for dosing coating substance on the web or on the roll, the blade contacting the web or roll at a contact line;

a hold-down device for forcing the blade onto the web or the roll, the hold-down device contacting the blade at a contact line;

a transmitter for transmitting a ray of light;

at least one light-reflecting layer for reflecting the ray of light, said light-reflecting layer being positioned at an area of the blade between the contact line of the blade on the roll or web, and the contact line of the hold-down device and the blade, said light-reflecting layer being disposed on a side of the blade opposite the roll;

a receiver for receiving the reflected ray of light and registering a signal designating a position or angle of the ray of light reflected upon it by the light-reflecting layer of the blade; and a controller operatively connected to the receiver for receiving the signal from the receiver, and for controlling, dependent on the received signal, all angular position of the blade.

2. The apparatus of claim 1, wherein the hold-down device is flexible in a transverse direction to the blade.

3. The apparatus of claim 1, further comprising adjustment devices distributed uniformly along a width of the blade for local adjustment of contact pressure of the blade across the hold-down device.

4. The apparatus of claim 1, wherein the light-reflecting layer comprises a foil.

5. The apparatus of claim 4, wherein the weight per unit area of the foil including the light-reflecting layer is maximally 50 $g/m^2$.

6. The apparatus of claim 1, wherein the light-reflecting layer is applied as magnetic laminae or strips on a substrate for attachment to the blade.

7. The apparatus of claim 6, wherein the substrate is magnetic and has a tapered configuration to enable adjustment of a desired angle of incidence and angle of reflection of the transmitted light ray in relation to a plane, which in the area of its contact line on the roll or web extends through the blade.

8. The apparatus of claim 7, wherein the substrate and the light-reflecting layer applied on the substrate comprise glass, mirrored laminae measuring maximally 25 $mm^2$.

9. The apparatus of claim 1, wherein the hold-down device comprises a plurality of hold-down sections.

10. The apparatus of claim 1, wherein the transmitter comprises a laser-light transmitter.

11. The apparatus of claim 1, wherein the angular position of the blade is controlled in an area between the contact line of the hold-down device and the roll or web.

* * * * *

UNITED STATES PATENT AND TRADEMARK OFFICE

CERTIFICATE OF CORRECTION

PATENT NO. : 5,453,128

DATED : September 26, 1995

INVENTOR(S) : Martin Kustermann and Sergio Giuste

It is certified that error appears in the above-indentified patent and that said Letters Patent is hereby corrected as shown below:

Claim 1, at column 3, line 33, after "signal," delete "all" and insert --an--.

Signed and Sealed this

Nineteenth Day of December, 1995

*Attest:*

*Attesting Officer*

BRUCE LEHMAN

*Commissioner of Patents and Trademarks*